US010837292B2

(12) United States Patent
Jang

(10) Patent No.: US 10,837,292 B2
(45) Date of Patent: Nov. 17, 2020

(54) TURBINE BLADE WITH COOLING STRUCTURE, TURBINE INCLUDING SAME TURBINE BLADE, AND GAS TURBINE INCLUDING SAME TURBINE

(71) Applicant: DOOSAN HEAVY INDUSTRIES & CONSTRUCTION CO., LTD., Changwon-si (KR)

(72) Inventor: Yun Chang Jang, Gimhae-si (KR)

(73) Assignee: Doosan Heavy Industries Construction Co., Ltd, Gyeongsangnam-do (KR)

( * ) Notice: Subject to any disclaimer, the term of this patent is extended or adjusted under 35 U.S.C. 154(b) by 106 days.

(21) Appl. No.: 16/034,329

(22) Filed: Jul. 12, 2018

(65) Prior Publication Data

US 2019/0078444 A1 Mar. 14, 2019

(30) Foreign Application Priority Data

Sep. 13, 2017 (KR) ..... 10-2017-0117095

(51) Int. Cl.
*F01D 5/18* (2006.01)

(52) U.S. Cl.
CPC ..... *F01D 5/187* (2013.01); *F01D 5/186* (2013.01); *F05D 2220/32* (2013.01); *F05D 2220/76* (2013.01); *F05D 2240/14* (2013.01); *F05D 2240/30* (2013.01); *F05D 2260/20* (2013.01)

(58) Field of Classification Search
None
See application file for complete search history.

(56) References Cited

U.S. PATENT DOCUMENTS 7,094,031 B2 * 8/2006 Lee ..... F01D 5/187 416/97 R
2014/0178207 A1 * 6/2014 He ..... F01D 5/20 416/96 R

FOREIGN PATENT DOCUMENTS

JP 1989-134003 A 5/1989
JP 1999-022404 A 1/1999

* cited by examiner

*Primary Examiner* — Igor Kershteyn
*Assistant Examiner* — Juan G Flores
(74) *Attorney, Agent, or Firm* — Invenstone Patent, LLC

(57) ABSTRACT

A turbine blade with a cooling structure includes a root member coupled to a turbine disk; an inlet formed in the root member to introduce cooling air to the turbine blade; an airfoil coupled to the root member, the airfoil having a suction-side surface and a pressure-side surface; and an internal cooling channel disposed between the suction-side and pressure-side surfaces of the airfoil and configured to pass the cooling air throughout the airfoil from the inlet to an ejection hole formed on an upper surface of the airfoil. The turbine blade may be included in a turbine of a gas turbine and is provided to blow air passing through the cooling channel toward a leading edge and an upper surface of the airfoil, thereby reducing heat load and thermal stress applied to the turbine blade and preventing the turbine blade from being damaged by the heat load or thermal stress.

20 Claims, 5 Drawing Sheets

【FIG. 1】
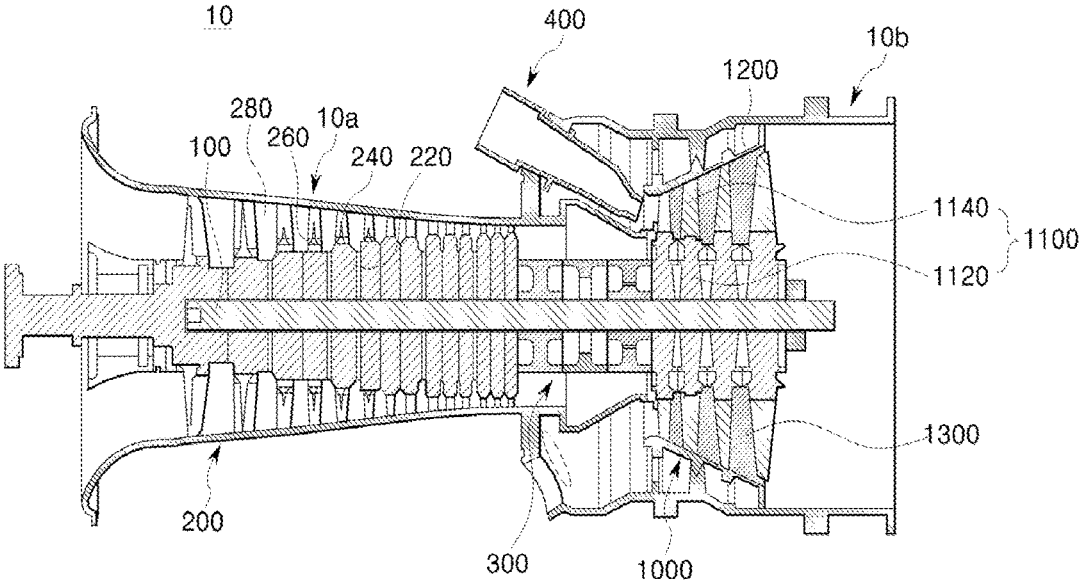

【FIG. 2】
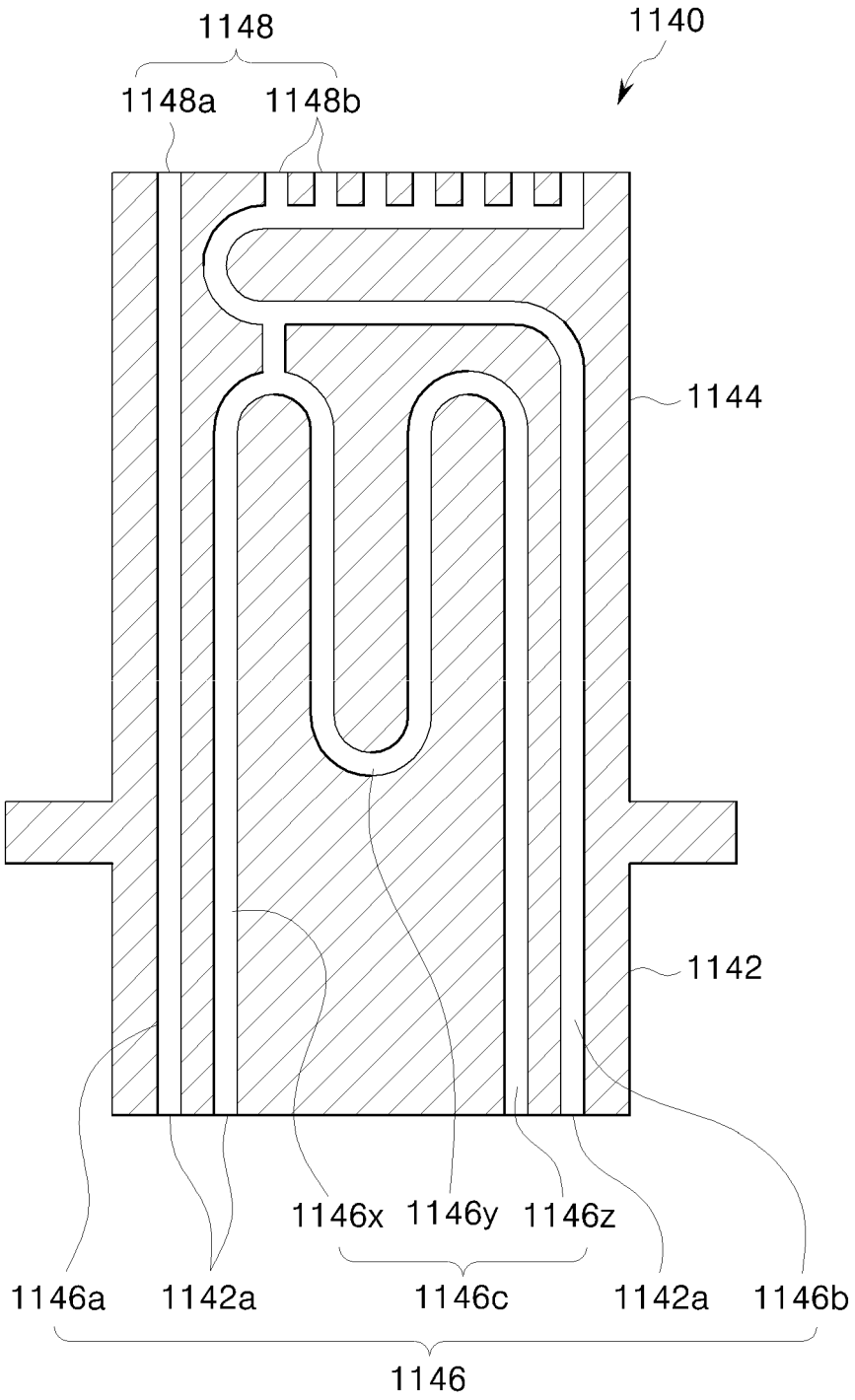

【FIG. 3】
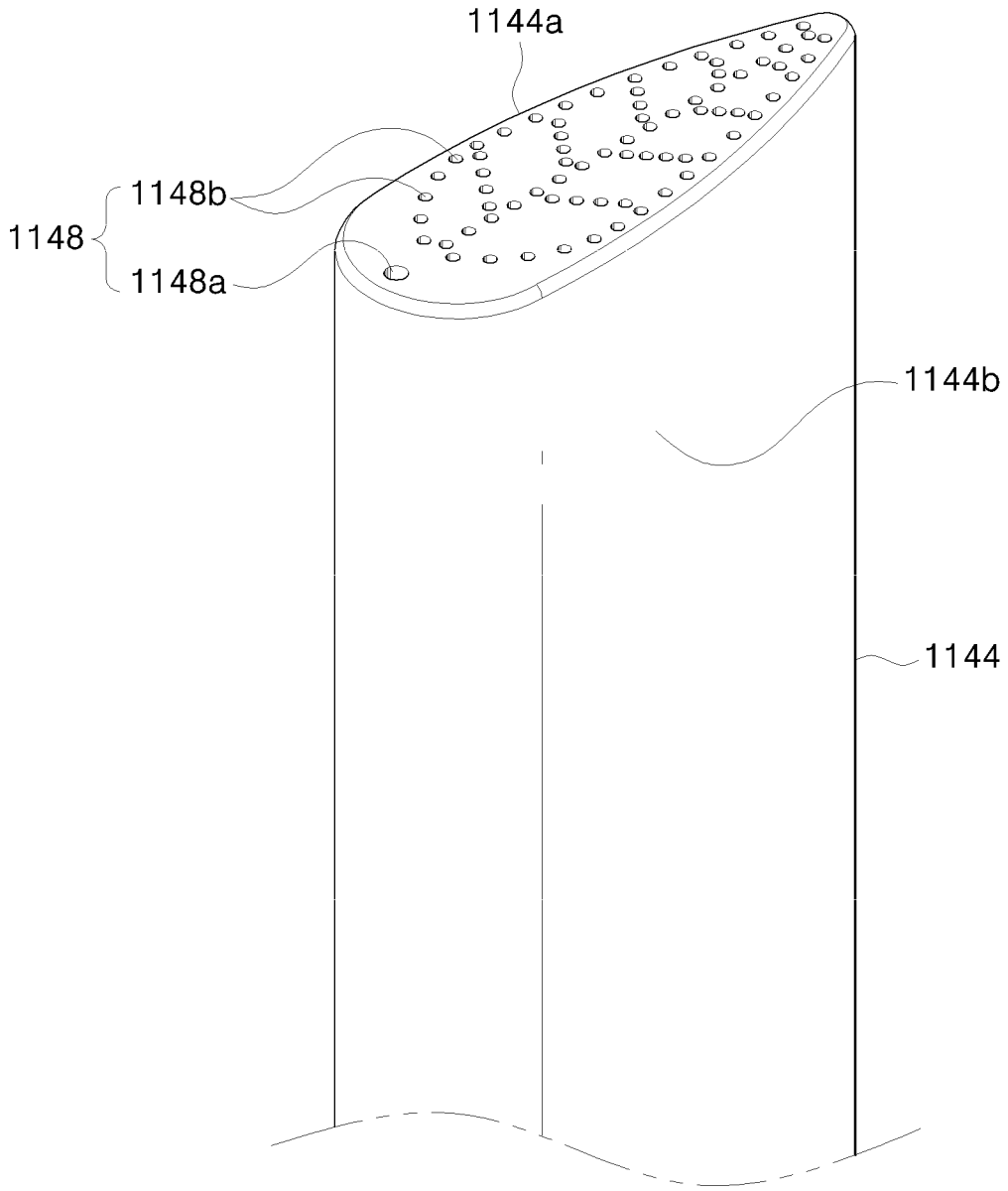

【FIG. 4】
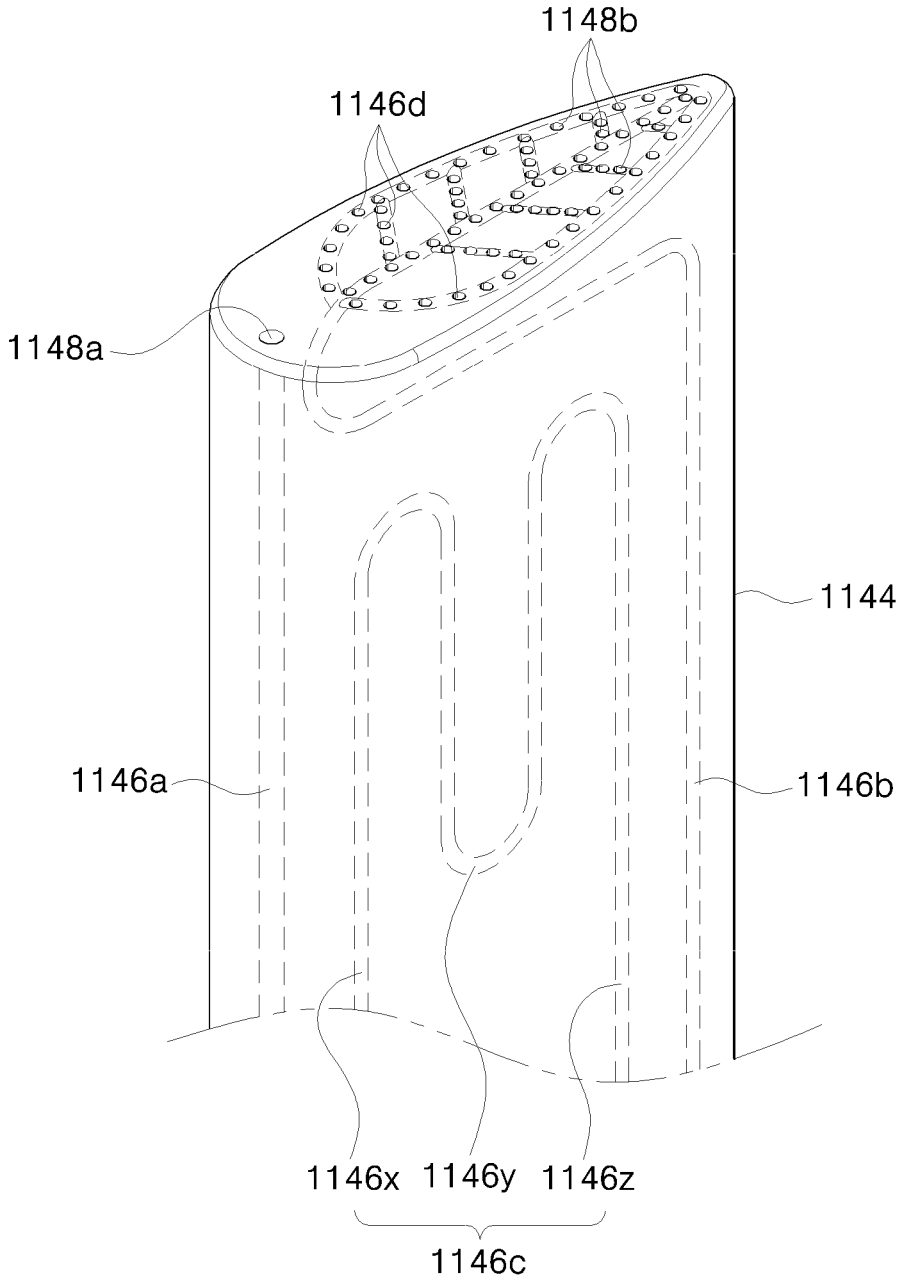

【FIG. 5】
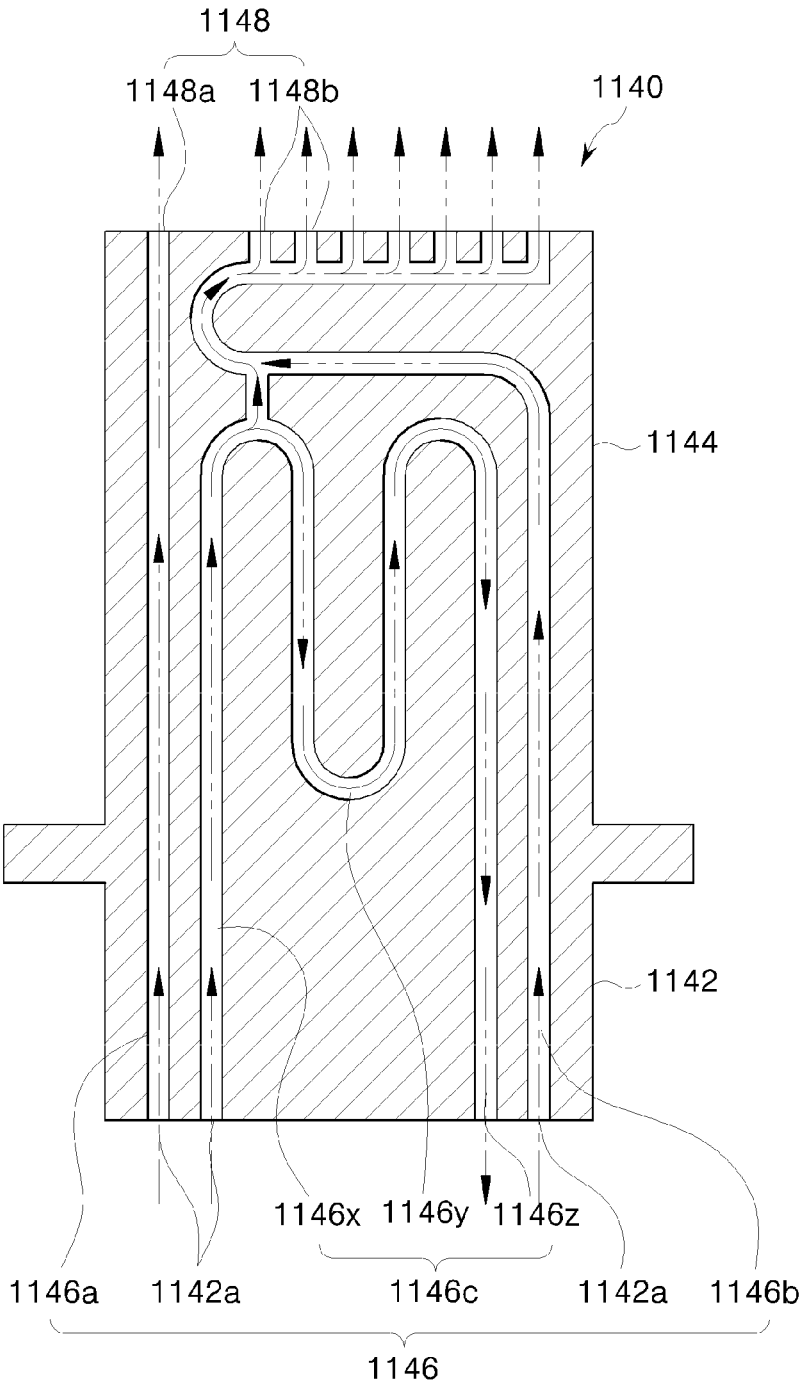

TURBINE BLADE WITH COOLING STRUCTURE, TURBINE INCLUDING SAME TURBINE BLADE, AND GAS TURBINE INCLUDING SAME TURBINE

CROSS REFERENCE TO RELATED APPLICATIONS

This application claims the benefit of Korean Patent Application No. 10-2017-0117095, filed on Sep. 13, 2017, in the Korean Intellectual Property Office, the disclosure of which is incorporated herein in its entirety by reference.

BACKGROUND OF THE DISCLOSURE

1. Field of the Disclosure

The present disclosure relates to a turbine blade, a turbine including the same turbine blade, and a gas turbine including the same turbine. More particularly, the present disclosure relates to a turbine blade including an airfoil having an internal cooling channel for circulation of cooling air through the turbine blade to improve cooling performance to prevent the temperature of the turbine blade from being increased by combustion gas flowing in a turbine casing. Additionally, the present disclosure relates to a turbine including the same turbine blade, and to a gas turbine including the same turbine.

2. Description of the Background Art

A turbine is a rotary mechanical device that rotates by an impulse force of or a reaction force to a flow of compressible fluid such as gas. Turbines are categorized into steam turbines using steam as the compressible fluid and gas turbines using hot combustion gas as the compressible fluid. A gas turbine is mainly composed of a compressor, a combustor, and a turbine. The compressor has an air inlet through which air is taken in and a compressor casing in which a plurality of compressor vanes and a plurality of compressor blades are alternately arranged.

The combustor mixes fuel with the compressed air generated by the compressor and ignites the fuel-air mixture with a burner to produce high-temperature high-pressure combustion gas. The turbine includes a turbine casing in which a plurality of turbine vanes and a plurality of turbine blades are alternately arranged. A rotor is arranged to extend through the centers of the compressor, the combustor, the turbine, and an exhaust chamber.

This gas turbine does not include a reciprocating mechanism such as a piston, which is usually present in a typical four-stroke engine. Therefore, it has no mutual frictional parts such as a piston-cylinder part, thereby consuming an extremely small amount of lubricating oil and reducing the amplitude of vibration, which results in high speed operation.

The operation of the gas turbine will be briefly described. Air is first compressed by the compressor and then mixed with fuel. Then, the fuel-air mixture is burnt to produce combustion gas which is then ejected toward the turbine. The ejected combustion gas causes rotary force while passing through between the turbine vanes and the turbine blades, so that the rotor of the turbine is rotated by the rotary force.

As a conventional technology related to a turbine of a gas turbine, Korean Utility Model No. 20-0174662 discloses a gas turbine.

Regarding such a conventional gas turbine, there is a trend of increasing the temperature of combustion gas introduced into a turbine to improve the output power and efficiency of the gas turbine. However, the increase in the temperature of combustion gas results in an increase in heat load or stress to the components of the turbine. Since the thermal resistance of the material of the components of the turbine is limited, when the temperature of the combustion gas is increased, there is a problem that a turbine blade is likely to be damaged.

BACKGROUND OF THE DISCLOSURE

The present disclosure has been made in order to solve the problems occurring in the related art, and the present disclosure is intended to provide a turbine blade including an airfoil having an internal cooling channel for circulation of cooling air therethrough and configured to blow air passing through the cooling channel toward a leading edge and an upper surface of the airfoil, thereby reducing heat load and thermal stress applied to the turbine blade and preventing the turbine blade from being damaged by the heat load or thermal stress. The present invention is also intended to provide a turbine including the same turbine blade, and a gas turbine including the same turbine.

In order to accomplish the above objects, one aspect of the present disclosure provides a turbine blade with a cooling structure. The turbine blade may include a root member coupled to a turbine disk; an inlet formed in the root member to introduce cooling air to the turbine blade; an airfoil coupled to the root member, the airfoil having a suction-side surface and a pressure-side surface; and an internal cooling channel disposed between the suction-side and pressure-side surfaces of the airfoil and configured to pass the cooling air throughout the airfoil from the inlet to an ejection hole formed on an upper surface of the airfoil.

The cooling channel may include a first cooling channel configured to guide the cooling air introduced through the inlet to a leading edge of the airfoil of the turbine blade; a second cooling channel configured to guide the introduced cooling air so as to flow from a trailing edge of the airfoil of the turbine blade to the upper surface of the airfoil; and a third cooling channel provided between the first cooling channel and the second cooling channel and configured to circulate the introduced cooling air through an internal space of the airfoil of the turbine blade, wherein the second cooling channel and the third cooling channel locally communicate with each other.

The ejection hole may include a first ejection hole communicating with the first cooling channel and a second ejection hole communicating with the second cooling channel, and, as the second ejection hole, a plurality of second ejection holes may be formed on the upper surface of the airfoil of the turbine blade.

The turbine blade may further include a plurality of branch channels extending outward from a middle portion of the airfoil branches off from the second cooling channel disposed near the upper surface of the airfoil of the turbine blade.

The plurality of branch channels may communicate with the second ejection holes formed on the upper surface of the airfoil of the turbine blade.

The third cooling channel may guide the cooling air introduced from the leading edge of the airfoil of the turbine blade to the trailing edge of the airfoil of the turbine blade while allowing the cooling air to circulate through the airfoil, and wherein the third cooling channel includes an M-shaped configuration.

The third cooling channel may include an inflow path communicating with the inlet such that the cooling air is introduced into the inflow path; a circulation path connected to the inflow path and having a multi-fold snaking course to circulate the introduced cooling air; and a discharge path connected to the circulation path and allowing the cooling air circulated through the circulation path to be discharged. The circulation path connected to the inflow path may be configured to communicate with the second cooling channel.

Another aspect of the present disclosure provides a turbine generating driving force to be used for generation of electric power by passing a combustion gas supplied from a combustor. The turbine may include a turbine casing in which the combustion gas flows; and a turbine rotor rotatable inside the turbine casing, the turbine rotor including a plurality of turbine disks and a plurality of turbine blades coupled to an outer surface of each of the plurality of turbine disks. The plurality of turbine blades may include the above turbine blade.

According to another aspect of the present disclosure, a gas turbine may include a compressor to produce compressed air by taking in air and compressing the intake air; a combustor to produce combustion gas by burning a mixture of fuel and the compressed air supplied from the compressor; and the above turbine rotatable by the combustion gas supplied from the combustor.

The turbine blade with a cooling structure according to the present disclosure has a structure in which a plurality of cooling channels for circulating cooling air is formed in an airfoil of the turbine blade, and cooling air circulated through the plurality of cooling channels is ejected from a leading edge or an upper surface of the airfoil of the turbine blade to reduce heat load attributable to combustion gas, thereby preventing the turbine blade from being damaged or cracked by the heat load attributable to the combustion gas.

BRIEF DESCRIPTION OF THE DRAWINGS

The above and other objects, features and other advantages of the present disclosure will be more clearly understood from the following detailed description when taken in conjunction with the accompanying drawings, in which:

FIG. 1 is a schematic cross-sectional diagram of a gas turbine adopting a turbine blade with a cooling structure according to one embodiment of the present disclosure;

FIG. 2 is a cross-sectional view of a turbine blade included in the gas turbine of FIG. 1;

FIG. 3 is a perspective view of the turbine blade of FIG. 2, illustrating an upper surface of the turbine blade;

FIG. 4 is a perspective view of the turbine blade of FIG. 3, illustrating a second cooling channel formed in the turbine blade; and FIG. 5 is a cross-sectional view of the turbine blade of FIG. 2, illustrating the circulation of cooling air through the turbine blade along the cooling channel.

DETAILED DESCRIPTION OF THE DISCLOSURE

Hereinafter, a turbine blade with a cooling structure, a turbine including the cooling blade, and a gas turbine including the turbine, according to the present disclosure, will be described with reference to the accompanying drawings.

Referring to FIG. 1, a gas turbine 10 according to the present disclosure includes a tie rod 100, a compressor 200, a torque tube 300, a combustor 400, and a turbine 1000. The tie rod 100 is a rod-shaped member passing through the center of the gas turbine 10. The tie rod 100 serves to fasten together the compressor 200 and the turbine 1000.

The gas turbine 10 includes a housing 10*a* and a diffuser 10*b* that is provided at a rear end of the housing 10*a* and through which the combustion gas passing through the turbine 1000 is ejected. The combustor 400 is disposed in front of the diffuser 10*b* and burns fuel using compressed air supplied from the compressor 200.

In terms of the flow direction of air, the compressor 200 is situated on the upstream side of the housing 10*a* and the turbine 1000 including a multi-stage turbine rotor is situated on the downstream side of the housing 10*a*. Preferably, the torque tube 300 for transferring torque generated by the turbine 1000 to the compressor 200 is installed between the compressor 200 and the turbine 1000.

The compressor 200 is provided with a plurality of (for example, fourteen) compressor disks 220, and the compressor disks 220 are fastened by the tie rod 100 so as not to be spaced apart from each other in the axial direction of the tie rod 100.

The tie rod 100 passes through the centers of the compressor disks 220, which are thus arranged axially along the tie rod 100. One end of the tie rod 100 may be coupled the most upstream rotor disk and the other end may be fixed to the torque tube 300. Relative rotation is prevented between adjacent compressor disks 220, which are in pressure contact with each other.

A plurality of compressor blades 240 are radially coupled to an outer circumferential surface of each compressor disk 220. Each compressor blade 240 is coupled to the corresponding compressor disk 220 via a compressor blade root member 260.

Compressor vanes 280 are fixed to the housing 10*a* and arranged so as alternate with the compressor disks 220. Unlike the compressor disks 220, the compressor vanes 280 are stationary (fixed) members and do not rotate. The compressor vanes 280 regulate and guide the flow of compressed air passing through the airfoils of the compressor blades 240 coupled to the compressor disks 220, so that the compressed air can be transferred to the airfoils of the compressor blades 240 of the downstream compressor disk 220.

There are two types of coupling methods for compressor blade root members 260: a tangential type and an axial type. The coupling type of the compressor blade root member may be determined according to the structure of a gas turbine used. Typical compressor blades root members have a dove-tail structure or a fir-tree structure. Alternatively, the compressor blades may be coupled to the compressor rotor disk by means of different types of coupling member, such as, a key or a bolt.

The combustor 400 mixes the compressed air with fuel and burns the air-fuel mixture to produce high-temperature high-pressure combustion gas. The combustion process is performed under constant pressure so that the temperature of the combustion gas is increased to a heat-resistant temperature of the components of the combustor and the components of turbine.

The combustion system of the gas turbine includes a plurality of combustors provided as a plurality of cells in a casing. Each combustor includes a burner having a fuel injection nozzle and the like, a combustor liner defining a combustion chamber, and a transition piece serving as a connector between the combustor chamber and the turbine.

Particularly, the combustor liner provides a combustion zone in which the fuel injected through the fuel nozzle and the compressed air supplied from the compressor are mixed and burnt. In the combustor, the combustor liner encloses a combustion chamber in which a fuel and air mixture is combusted, and a flow sleeve forms an annulus space inside thereof while surrounding the combustor liner. A fuel nozzle assembly is coupled to a front end (i.e., upstream end) of the combustor liner, and a spark igniter plug is installed in the side of the combustor.

The transition piece is connected to a rear end (i.e., downstream end) of the combustor liner to deliver the combustion gas, produced in the combustion chamber after the flame is started by the spark igniter plug, to the turbine. Cooling of the outer surface of the transition piece is provided to prevent the transition piece from being damaged by the high temperature combustion gas. The transition piece may be cooled by a portion of the compressed air supplied from the compressor.

To this end, the transition piece is provided with cooling holes through which the compressed air can be injected into the transition piece. The air used to cool the combustion piece flows toward the combustion liner.

The air used for cooling the transition piece flows through the annulus space provided between the combustor liner and the flow sleeve. In addition, a portion of the compressed air for cooling also may be externally introduced into the annulus space through cooling holes formed in the flow sleeve to flow along the outer surface of the combustor liner. This incoming air introduced through the cooling holes formed in the flow sleeve and the outgoing air passing through the transition piece may collide in the annulus space.

The high-temperature high-pressure combustion gas ejected from the combustor 400 is introduced into the turbine 1000. The supplied high-temperature high-pressure combustion gas expands in the turbine 1000 and gives a reaction force or impulse force to the blades of the turbine to generate torque. The torque is transmitted to the compressor 200 via the torque tube 300 described above. The excessive power exceeding the power required to drive the compressor is used to drive an electric generator or the like.

The turbine 1000 and the compressor 200 are basically similar in their structure. The turbine 1000 includes a plurality of turbine rotors 1100 including a plurality of turbine disks 1120 and a plurality of turbine blades 1140.

The multiple turbine blades 1140 are coupled to the outer surface of each of the turbine disks 1120. The multiple turbine disks 1120 are fitted on the outer circumferential surface of the tie rod 100 and are rotated by the combustion gas supplied from the combustor 400. The multiple turbine blades 1140 are coupled to the outer surface of each of the turbine disks 1120.

The turbine blades 1140 are coupled to the turbine disk 1120 in a dovetail connection manner. The multi-stage turbine disks 1120 are fitted on the outer circumferential surface of the tie rod 100. The turbine also includes a turbine casing 1200, and multiple turbine vanes 1300 are arranged between the turbine blades 1140 and fixed to the turbine casing 1200. The turbine vanes 1300 guide the flow of the combustion gas passing through between the turbine blades 1140.

The multiple turbine vanes 1300 are arranged in multiple rows. The turbine vales 1300 in each row are arranged in a circumferential direction of the turbine casing 1200. The turbine vanes 1300 and the turbine blades 1140 are arranged alternately in the axial direction of the tie rod 100 while being misaligned with each other.

Referring to FIGS. 1 and 2, each of the turbine blades 1140 mounted in multiple rows inside the turbine casing 1200 include a turbine blade root member 1142 and a turbine blade airfoil 1144.

The turbine blade root member 1142 is coupled to the turbine disk 1120. Preferably, the turbine blade root member 1142 is coupled to the turbine disk 1120 in the same manner as the compressor blade root member 260 of the compressor blade 240. The turbine blade airfoil 1144 is integrally formed on the turbine blade root member 1142 and collides with the high-temperature high-pressure combustion gas introduced into the turbine casing 1200. The turbine blade airfoil 1144 has a suction-side surface 1144*a* and a pressure-side surface 1144*b*.

The turbine blade airfoil 1144 has the convex-curved suction-side surface 1144*a* disposed at a front surface side in a direction in which the combustion gas is introduced and the concave-curved pressure-side surface 1144*a* that is disposed at a rear surface side and is recessed toward the suction-side surface 1144*a*. Since the pressure difference between the front surface and the rear surface of the turbine blade airfoil 1144, i.e., the pressure difference between the suction-side surface 1144*a* and the pressure-side surface 1144*b*, is maximized, a smooth air flow can be achieved.

The turbine blade root member 1142 is provided with an inlet 1142*a* through which cooling air is introduced into the turbine blade airfoil 1144 in order to reduce the thermal load of the turbine blade airfoil 1144 generated by the combustion gas. A cooling channel 1146 communicating with the inlet 1142*a* is formed in the turbine blade airfoil 1144. The cooling channel 146 extends through the inside of the turbine blade airfoil 1144. An ejection hole portion 1148 communicating with the cooling channel 1146 is formed in the upper surface of the turbine blade airfoil 1144. The cooling air passing through the cooling channel 1146 is supplied to the upper surface of the turbine blade airfoil 1144 and is discharged through the ejection hole portion 1148.

Cooling air having a lower temperature than the combustion gas is introduced into the internal cooling channel 1146 through the inlet 1142*a*. Then, the introduced cooling air performs heat exchange with the inner surface of the turbine blade airfoil 1144, thereby lowering the temperature of the turbine blade air foil 1144 and the turbine blade 1140. The cooling channel 1146 includes a first cooling channel 1146*a*, a second cooling channel 1146*b*, and a third cooling channel 1146*c*. The ejection hole portion 1148 communicating with the cooling channel 1146 includes a first ejection hole 1148*a* and a second ejection hole 1148*b*.

Referring to FIGS. 4 and 5, the cooling air introduced through the inlet 1142*a* circulates through the internal space of the turbine blade 1140 by flowing through the first cooling channel 1146*a*, the second cooling channel 1146*b*, and the third cooling channel 1146*c*. Preferably, each of the first, second, and third cooling channels 1143*a*, 1143*b*, and 1146*c* are provided with ribs (not shown) to increase a heat exchange performance of the cooling air.

The first cooling channel 1146*a* guides the cooling air introduced through the inlet 1142*a* to the leading edge of the turbine blade airfoil 1144, thereby lowering the temperature of the turbine blade airfoil 1144 or lowering the temperature of the entire turbine blade 1140. The first cooling channel 1146*a* communicates with the first ejection hole 1148*a* so that the cooling air introduced into the first cooling channel 1146*a* is discharged from the turbine blade 1140 through the first ejection hole 1148*a*.

The second cooling channel 1146*b* allows the cooling air introduced through the inlet 1142*a* to flow from the trailing edge of the turbine blade airfoil 1144 to the upper surface of the turbine blade airfoil 1144. The second cooling channel 1146*b* includes an upper portion disposed near the upper surface of the airfoil 1144 and a main portion disposed below the upper portion to guide the introduced cooling air from the inlet 1142*a* to the upper portion of the second cooling channel 1146*b*. The second cooling channel 1146*b* communicates with the second ejection hole 1148*b*. As the second ejection hole 1148*b*, the upper surface of the airfoil 1144 is provided with a plurality of second ejection holes 1148*b*. The plurality of second ejection holes 1148*b* includes a series of ejection holes arranged in a downstream direction from the first cooling channel 1146*a* to the trailing edge of the airfoil 1144, the series of ejection holes including a last ejection hole formed nearest the trailing edge of the airfoil and thus disposed toward a downstream end of the second cooling channel 1146*b*.

Referring to FIG. 3, the first ejection hole 1148*a* and the plurality of second ejection holes 1148*b* are formed in the upper surface of the turbine blade airfoil 1144, in which the first ejection hole 1148*a* is formed toward the leading edge of the turbine blade airfoil 1144 and the plurality of second ejection holes 1148*b* are distributed over the entire upper surface of the turbine blade airfoil 1144. Therefore, it is possible to lower the temperature of the upper surface of the turbine blade airfoil 1144 by using the cooling air that circulates through the first cooling channel 1146*a* and the second cooling channel 1146*b*.

Referring to FIG. 4, the second cooling channel 1146*b*, which is positioned near the upper surface of the turbine blade airfoil 1144, is provided with a plurality of branch channels 1146*d* extending outward from a middle portion of the turbine blade airfoil 1144. The branch channels 1146*d* communicate with the second ejection holes 1148*b* so that the cooling air flowing through the second cooling channels 1146*b* and the branch channels 1146*d* is discharged from the turbine blade 1140 through the second ejection holes 1146*b*.

Referring to FIG. 5, a third cooling channel 1146*c* is provided between the first cooling channel 1146*a* and the second cooling channel 1146*b*. The third cooling channel 1146*c* allows the cooling air introduced through the inlet 1142*a* to circulate through the internal space of the turbine blade airfoil 1144. The second cooling channel 1146*b* and the third cooling channel 1146*c* are locally connected to each other so as to communicate with each other. That is, the second and third cooling channels 1146*b* and 1146*c* communicate with each other through a commonly shared interconnecting channel.

The third cooling channel 1146*c* allows the cooling air introduced from the leading edge of the turbine blade airfoil 1144 to circulate through the turbine blade airfoil 1144, and thus transports the introduced cooling air to the trailing edge of the turbine blade airfoil 1144. The third cooling channel 1146*c* has a generally M-shaped configuration of a snaking course of multiple folds. According to the M-shaped configuration, the third cooling channel 1146*c* includes an inflow path 1146*x*, a circulation path 1146*y*, and a discharge path 1146*z*.

The inflow path 1146*x* communicates with the inlet 1142*a* to allow cooling air to be introduced into the turbine blade airfoil 1144 through the inlet 1142*a*. The circulation path 1146*y* is connected to the inflow path 1146*x*. The snaking course of the circulation path 1146*y* enables the introduced air to sufficiently circulate in the turbine blade airfoil 1144. The cooling air circulates in the turbine blade airfoil 1144 by flowing along the circulation path 1146*y*, thereby improving heat exchange efficiency. The discharge path 1146*z* is connected to the circulation path 1146*y*, so that the cooling air circulated through the internal space of the turbine blade airfoil 1144 is discharged from the turbine blade 1140 through the discharge passage 1146*z*.

The turbine disk 1120 is a rotating body that rotates together with the turbine blades 1140 when the turbine blades 1140 are rotate by the pressure of the combustion gas. The turbine vanes 1300 are fixed to the turbine casing 1200. That is, each of the turbine vanes 1300 is a fixed body that is stationary regardless of the rotation of the turbine blade 1140. The combustion gas passes through between the turbine blades 1140 and in doing so, pushes the turbine blades 1140. When the combustion gas pushes the turbine blades 1140, the turbine blades 1140 and the turbine disk 1120 rotate about the tie rod 100 serving as a central axis. The combustion gas passing through the airfoils of the turbine blades 1140 is guided by the turbine vane 1300 so that its flow direction can be changed and is finally discharged to the outside through the diffuser 10*b*.

Conventional turbine blades are likely to be damaged and destroyed by a thermal load of the combustion gas. However, according to the present disclosure, multiple cooling channels 1146 through which the cooling air circulates are formed in the turbine blade airfoil 1144. Therefore, the thermal load on the leading edge and the upper surface of the turbine blade 1140 is reduced by the cooling air circulating through the cooling channels 1146, which prevents the turbine blade 1140 from being damaged or destroyed by thermal stress.

While the present disclosure has been described with reference to exemplary embodiments, those skilled in the art will appreciate that the exemplary embodiments are presented only for illustrative purposes and the present disclosure is not limited to the disclosed exemplary embodiments. On the contrary, it will be understood that various modifications and equivalents thereof are possible. Accordingly, the true technical protection scope of the present disclosure should be determined by the technical idea defined in the appended claims.

What is claimed is:

1. A turbine blade with a cooling structure, the turbine blade comprising:

a root member coupled to a turbine disk;

an inlet formed in the root member to introduce cooling air to the turbine blade;

an airfoil coupled to the root member, the airfoil having a suction-side surface and a pressure-side surface; and an internal cooling channel disposed between the suction-side and pressure-side surfaces of the airfoil and configured to pass the cooling air throughout the airfoil from the inlet to at least one ejection hole formed on an upper surface of the airfoil, the internal cooling channel comprising:

a first cooling channel configured to guide the cooling air introduced through the inlet to a leading edge of the airfoil; and a second cooling channel configured to guide the introduced cooling air so as to flow from a trailing edge of the airfoil to the upper surface of the airfoil, the second cooling channel including an upper portion disposed near the upper surface of the airfoil, wherein the upper portion of the second cooling channel includes an upstream end disposed near the first cooling channel and a downstream end disposed near the trailing edge of the airfoil and runs substantially parallel to the upper surface of the airfoil between the upstream end and the downstream end.

2. The turbine blade according to claim 1, wherein the internal cooling channel further includes:

a third cooling channel provided between the first cooling channel and the second cooling channel and configured to circulate the introduced cooling air through an internal space of the airfoil of the turbine blade, wherein the second cooling channel and the third cooling channel locally communicate with each other.

3. The turbine blade according to claim 2, wherein the third cooling channel guides the cooling air introduced from the leading edge of the airfoil of the turbine blade to the trailing edge of the airfoil of the turbine blade while allowing the cooling air to circulate through the airfoil, and wherein the third cooling channel includes an M-shaped configuration.

4. The turbine blade according to claim 2, wherein the third cooling channel comprises:

an inflow path communicating with the inlet such that the cooling air is introduced into the inflow path;

a circulation path connected to the inflow path and having a multi-fold snaking course to circulate the introduced cooling air; and a discharge path connected to the circulation path and allowing the cooling air circulated through the circulation path to be discharged from the turbine blade, wherein the circulation path connected to the inflow path is configured to communicate with the second cooling channel.

5. The turbine blade according to claim 2, wherein the third cooling channel communicates with the second cooling channel between and the upper portion of the second cooling channel and the inlet.

6. The turbine blade according to claim 5, wherein the third cooling channel communicates with the second cooling channel at one location.

7. The turbine blade according to claim 5, wherein the third cooling channel does not communicate with the upper surface of the airfoil.

8. The turbine blade according to claim 1, wherein the at least one ejection hole includes a first ejection hole and a plurality of second ejection holes, the first ejection hole communicating with the first cooling channel and the plurality of second ejection holes respectively communicating with the second cooling channel.

9. The turbine blade according to claim 8, further comprising:

a plurality of branch channels extending outward from a middle portion of the airfoil that branch off from the second cooling channel disposed near the upper surface of the airfoil of the turbine blade.

10. The turbine blade according to claim 9, wherein the plurality of branch channels communicate with the plurality of second ejection holes formed on the upper surface of the airfoil of the turbine blade.

11. The turbine blade according to claim 1, wherein the second cooling channel is further configured to guide the introduced cooling air from the inlet to the at least one ejection hole.

12. The turbine blade according to claim 11, wherein the second cooling channel further includes a main portion configured to guide the introduced cooling air from the inlet to the upper portion of the second cooling channel.

13. The turbine blade according to claim 11, wherein the at least one ejection hole includes a last ejection hole formed nearest the trailing edge of the airfoil, and wherein the upstream end of the upper portion of the second cooling channel communicates with the main portion of the second cooling channel, and the downstream end of the upper portion of the second cooling channel communicates with the last ejection hole.

14. The turbine blade according to claim 1, wherein the upper portion of the second cooling channel occupies a middle portion of the airfoil centrally disposed between the suction-side surface and the pressure-side surface.

15. The turbine blade according to claim 1, wherein the second cooling channel includes a plurality of branch channels respectively branching off from the upper portion of the second cooling channel between the upstream end and the downstream end.

16. The turbine blade according to claim 1, wherein the at least one ejection hole includes a first ejection hole and a plurality of second ejection holes, the first ejection hole having a first end communicating with the upper surface of the airfoil and a second end communicating with the first cooling channel, each of the plurality of second ejection holes having a first end communicating with the upper surface of the airfoil and a second end communicating with the upper portion of the second cooling channel.

17. The turbine blade according to claim 16, wherein the second cooling channel includes a plurality of branch channels respectively branching off from the upper portion of the second cooling channel between the upstream end and the downstream end, the plurality of branch channels respectively communicating with the plurality of second ejection holes.

18. The turbine blade according to claim 17, wherein the plurality of branch channels include an outer branch channel and a plurality of inner branch channels, the outer branch channel communicating with the upstream and downstream ends of the upper portion of the second cooling channel and the plurality of inner branch channels respectively branching off from alternating sides of the upper portion of the second cooling channel at staggered locations between the upstream end and the downstream end, and wherein each of the plurality of inner branch channels has one end communicating with the outer branch channel.

19. A turbine generating driving force to be used for generation of electric power by passing a combustion gas supplied from a combustor, the turbine comprising:

a turbine casing in which the combustion gas flows; and a turbine rotor rotatable inside the turbine casing, the turbine rotor including a plurality of turbine disks and a plurality of turbine blades coupled to an outer surface of each of the plurality of turbine disks, wherein a turbine blade of the plurality of turbine blades comprises:

a root member coupled to a turbine disk of the plurality of turbine disks;

an inlet formed in the root member to introduce cooling air to the turbine blade;

an airfoil coupled to the root member, the airfoil having a suction-side surface and a pressure-side surface; and an internal cooling channel disposed between the suction-side and pressure-side surfaces of the airfoil and configured to pass the cooling air throughout the airfoil from the inlet to at least one ejection hole formed on an upper surface of the airfoil, the internal cooling channel comprising:

a first cooling channel configured to guide the cooling air introduced through the inlet to a leading edge of the airfoil; and a second cooling channel configured to guide the introduced cooling air so as to flow from a trailing edge of the airfoil to the upper surface of the airfoil, the second cooling channel including an upper portion disposed near the upper surface of the airfoil, wherein the upper portion of the second cooling channel includes an upstream end disposed near the first cooling channel and a downstream end disposed near the trailing edge of the airfoil and runs substantially parallel to the upper surface of the airfoil between the upstream end and the downstream end.

20. A gas turbine comprising:

a compressor to produce compressed air by taking in air and compressing the intake air;

a combustor to produce combustion gas by burning a mixture of fuel and the compressed air supplied from the compressor; and a turbine rotatable by the combustion gas supplied from the combustor, the turbine comprising:

a turbine casing in which the combustion gas flows; and a turbine rotor rotatable inside the turbine casing, the turbine rotor including a plurality of turbine disks and a plurality of turbine blades coupled to an outer surface of each of the plurality of turbine disks, wherein a turbine blade of the plurality of turbine blades comprises a root member coupled to a turbine disk of the plurality of turbine disks; an inlet formed in the root member to introduce cooling air to the turbine blade; an airfoil coupled to the root member, the airfoil having a suction-side surface and a pressure-side surface; and an internal cooling channel disposed between the suction-side and pressure-side surfaces of the airfoil and configured to pass the cooling air throughout the airfoil from the inlet to at least one ejection hole formed on an upper surface of the airfoil, the internal cooling channel comprising:

a first cooling channel configured to guide the cooling air introduced through the inlet to a leading edge of the airfoil; and a second cooling channel configured to guide the introduced cooling air so as to flow from a trailing edge of the airfoil to the upper surface of the airfoil, the second cooling channel including an upper portion disposed near the upper surface of the airfoil, wherein the upper portion of the second cooling channel includes an upstream end disposed near the first cooling channel and a downstream end disposed near the trailing edge of the airfoil and runs substantially parallel to the upper surface of the airfoil between the upstream end and the downstream end.

* * * * *